US006948959B2

(12) United States Patent
Miyamoto

(10) Patent No.: US 6,948,959 B2
(45) Date of Patent: Sep. 27, 2005

(54) CONNECTOR HAVING A MOVABLE MEMBER

(75) Inventor: Toshifumi Miyamoto, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/030,356

(22) Filed: Jan. 6, 2005

(65) Prior Publication Data

US 2005/0148221 A1 Jul. 7, 2005

(30) Foreign Application Priority Data

Jan. 7, 2004 (JP) ..... 2004-002350

(51) Int. Cl.[7] ..... H01R 13/62

(52) U.S. Cl. ..... 439/157; 439/372

(58) Field of Search ..... 439/157, 158, 439/159, 160, 372

(56) References Cited

U.S. PATENT DOCUMENTS

| | | | | |
|---|---|---|---|---|
| 5,575,671 | A | 11/1996 | Katsuma | 439/157 |
| 5,876,225 | A * | 3/1999 | Katsuma et al. | 439/157 |
| 6,264,485 | B1 * | 7/2001 | Saka et al. | 439/157 |
| 6,764,324 | B2 * | 7/2004 | Shinozaki et al. | 439/157 |

* cited by examiner

*Primary Examiner*—Briggitte R. Hammond
(74) *Attorney, Agent, or Firm*—Gerald E. Hespos; Anthony J. Casella

(57) ABSTRACT

A connector (F) has a main body (10) with an outer surface. Shafts (11) project from the outer surface and a retainer (12) projects from each shaft (11). A lever (20) has bearing holes (23) with notches (26) dimensioned to receive one of the retainers (12). The notches (26) align with the retainers (12) in a connection ending position of the lever (20) so that the lever (20) can be mounted rotationally on the main body (10) or removed from the main body (10). A resilient lock (14) presses the lever (20) parallel to the axis of the shafts (11) so that the retainers (12) engage edges of the bearing holes (23) to prevent detachment of the lever (20) from the shafts (11) in other rotational orientations.

14 Claims, 9 Drawing Sheets

CONNECTOR HAVING A MOVABLE MEMBER

BACKGROUND OF THE INVENTION

1. Field of the Invention

The invention relates to a connector having a movable member for assisting or performing a connection with a mating connector.

2. Description of the Related Art

A lever-type connector has a main body with an outer surface and a support shaft that projects from the outer surface. The connector also has a lever with a plate-shaped arm that extends along the outer surface of the main body. The arm has a bearing hole and a cam groove with an entrance. The bearing hole is supported rotatably on a support shaft of the main body. Thus, the lever can rotate between a connection starting position where the entrance of the cam groove faces a mating connector and a connection ending position rotated angularly from the connection starting position. The mating connector has a cam follower that can fit in the entrance of the cam groove when the lever is at the connection starting position. The lever then is rotated towards the connection ending position. Thus, the cam groove engages the cam follower and pulls the connectors towards a connected state.

A resilient locking piece could be provided on the outer surface of the main body for holding the lever at the connection starting position or the connection ending position. The locking piece is deformed by interference with the inner surface of the arm in the process of rotating the lever. However, the locking piece is restored resiliently and engages the arm to prevent rotation of the lever when the lever is at the connection starting position or the connection ending position. The resilient locking piece is held resiliently in sliding contact with the inner surface of the arm during at least a part of the lever rotating process. Thus, a force is exerted on the arm of the lever in a direction away from the outer surface of the main body and in a direction to disengage the bearing hole from the supporting shaft.

U.S. Pat. No. 5,575,671 discloses a connector with a retaining means for preventing disengagement of the bearing hole from the support shaft. More particularly, the connector has a retainer that projects radially at the leading end of the support shaft. A notch is formed at the opening edge of the bearing hole for receiving the retainer. The lever can be mounted on or removed from the support shaft only at one rotational posture of the lever. In other postures, the retainer engages the opening edge of the bearing hole from the outer side to prevent the bearing hole from being engaged and disengaged.

The above-described retaining means may not function as intended. For example, the retainer and the notch could be aligned while the resilient locking piece is pressing the lever. In this situation, the resilient pressing force exerted by the resilient locking piece could disengage the bearing hole from the support shaft.

The invention was developed in view of the above problem and an object thereof is to prevent a movable member from being displaced along the longitudinal direction of a supporting shaft due to a resilient pressing force from a resilient locking piece that prevents the movement of the movable member.

SUMMARY OF THE INVENTION

The invention relates to a connector with a movable member. The connector has a main body with an outer surface and at least one shaft projects from the outer surface. The movable member has at least one bearing hole and is supported movably on the main body by engaging the bearing hole with the shaft. A notch is formed at an opening edge of the bearing hole and a retainer projects on the shaft. The notch receives the retainer so that the movable member can be attached to and detached from the shaft in selected orientations of the movable member and the shaft. However, the opening edge of the bearing hole engages the retainer in other orientations to prevent detachment of the movable member from the shaft. A resilient lock is provided on the main body or the movable member and is deformable parallel to the longitudinal axis of the shaft. The lock is deformed into sliding contact with the movable member or the main body when the movable member is in an interference area. However, the lock can return resiliently to an unbiased state where the lock does not slide in contact with either the movable member or the main body. The lock prevents movement of the movable member when the lock is in the unbiased undeformed state that defines a non-interference are for the movable member. The notch and the retainer align only when the movable member is in the non-interference area.

The notch and the retainer align only when the movable member is in the non-interference area, and hence when the lock is not deformed. The movable member can be attached and detached only in this state. The resilient lock presses the movable member or the main body substantially parallel with the longitudinal axis of the shaft when the movable member is in the interference area. This is an area where the retainer engages the opening edge of the bearing hole to prevent detachment of the movable member from the shaft. Thus, the resilient restoring force of the lock cannot detach the movable member from the shaft, thereby improving efficiency of the connector.

The movable member preferably comprises a lever with the at least one bearing hole that rotatably supports the lever on the main body. The lever preferably is supported for rotation between a connection starting position and a connection ending position.

The connector preferably is mateable with a mating connector that has a cam follower. The lever preferably has a cam groove that can engage the cam follower when the lever is at a connection starting position. The cam follower follows the cam groove as the lever is moved, and hence the mating connector is pulled towards the main body. The mating connector and the main body are connected properly when the lever reaches a connection ending position. The connection ending position preferably is in the non-interference area. The notch and the retainer preferably aligned with each other only at the connection ending position.

The lever generally is held at the connection starting position when the connector is transported to a site for connection with the mating connector to ensure that the lever is positioned for efficiently starting the connecting operation. The retainer and the notch are not aligned at the connection starting position. Thus, there is no possibility that the lever will detach from the main body during transportation. Further, the retainer and the notch are not aligned in the process of rotating the lever between the connection starting position and the connection ending position. Thus, there is no possibility that the lever will detach during the rotation.

The resilient lock in the free state preferably prevents movement of the movable member from the connection ending position towards the connection starting position. Thus, the connectors can be locked in their connected state.

The mating connector preferably has a receptacle that can face the movable member from an outer side. The receptacle prevents the movable member from being displaced from the shaft during the connecting operation.

The connection starting position preferably is in the non-interference area. Accordingly, the resilient lock is not deformed when the lever is at the connection starting position, and the resilient lock is not set in fatigue even if the lever is left at the connection starting position over a long period.

These and other objects and features of the invention will become more apparent upon reading the following description of preferred embodiments and accompanying drawings. Even though embodiments are described separately, the features thereof may be recombined.

DETAILED DESCRIPTION OF THE PREFERRED EMBODIMENTS

Figure 1:
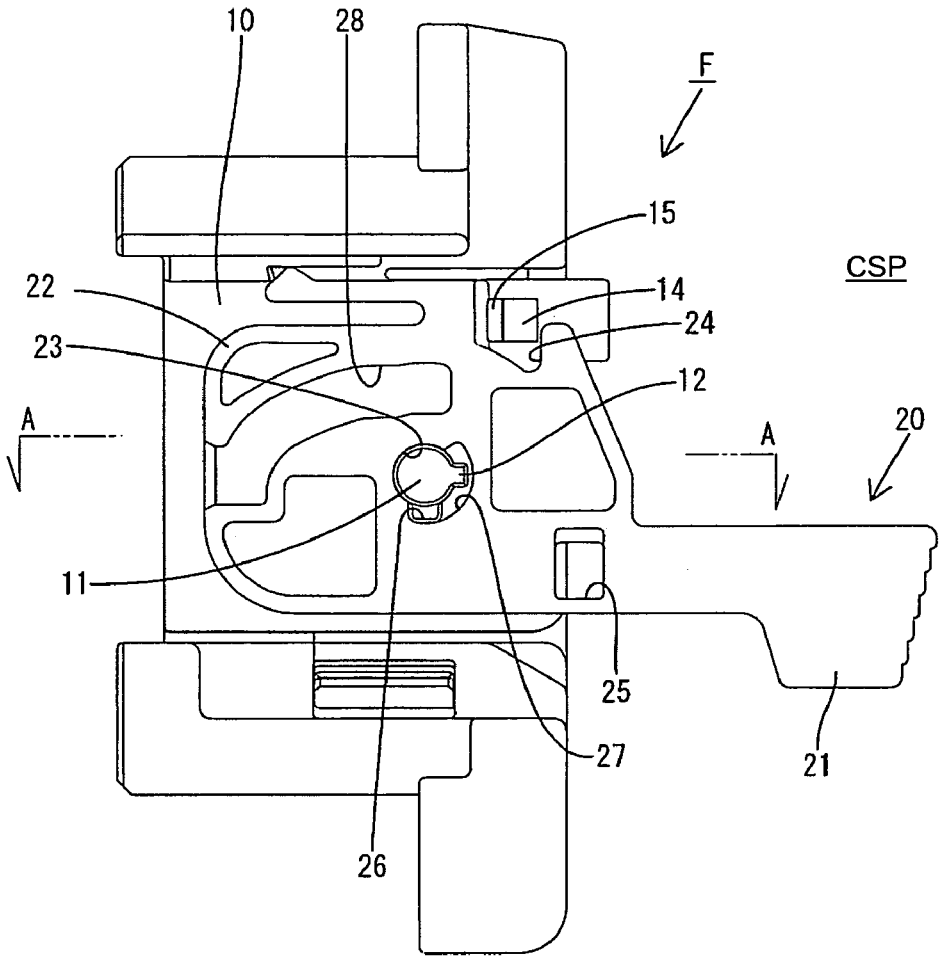
FIG. 1 is a side view showing a state where a lever is located at a connection starting position in one embodiment of the invention.
Figure 2:
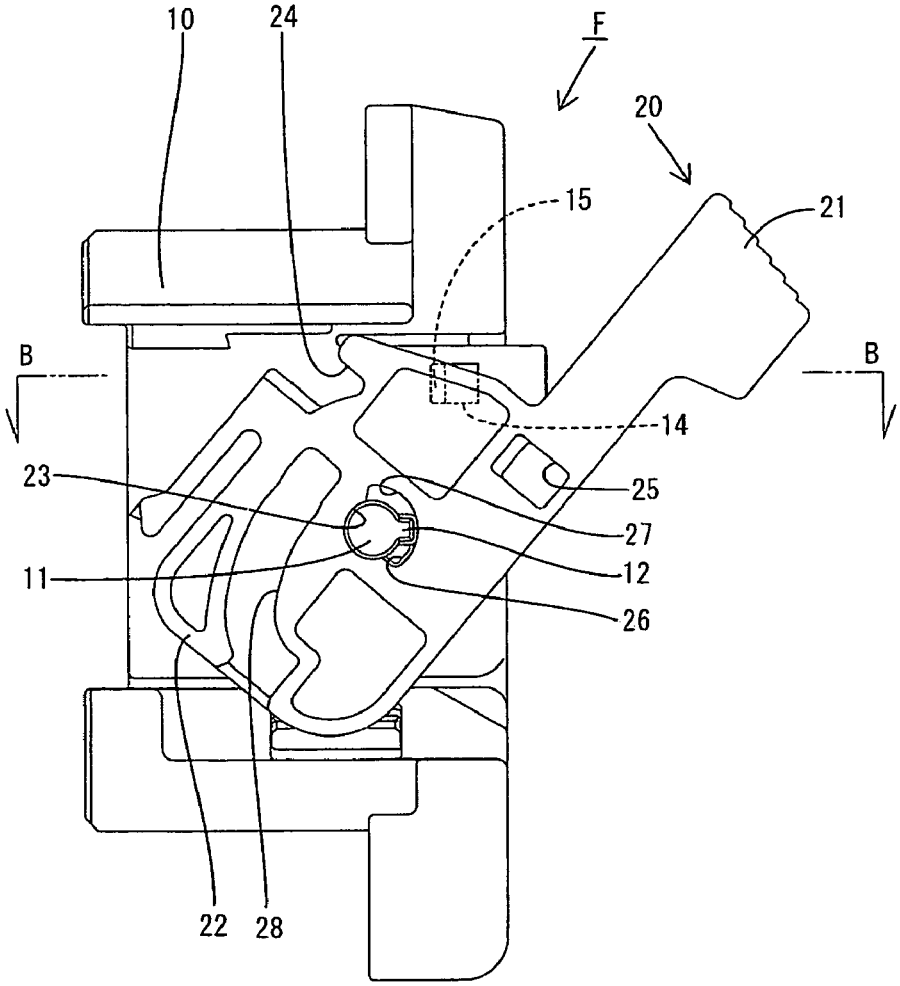
FIG. 2 is a side view showing a state where the lever is located between the connection starting position and a connection ending position.
Figure 3:
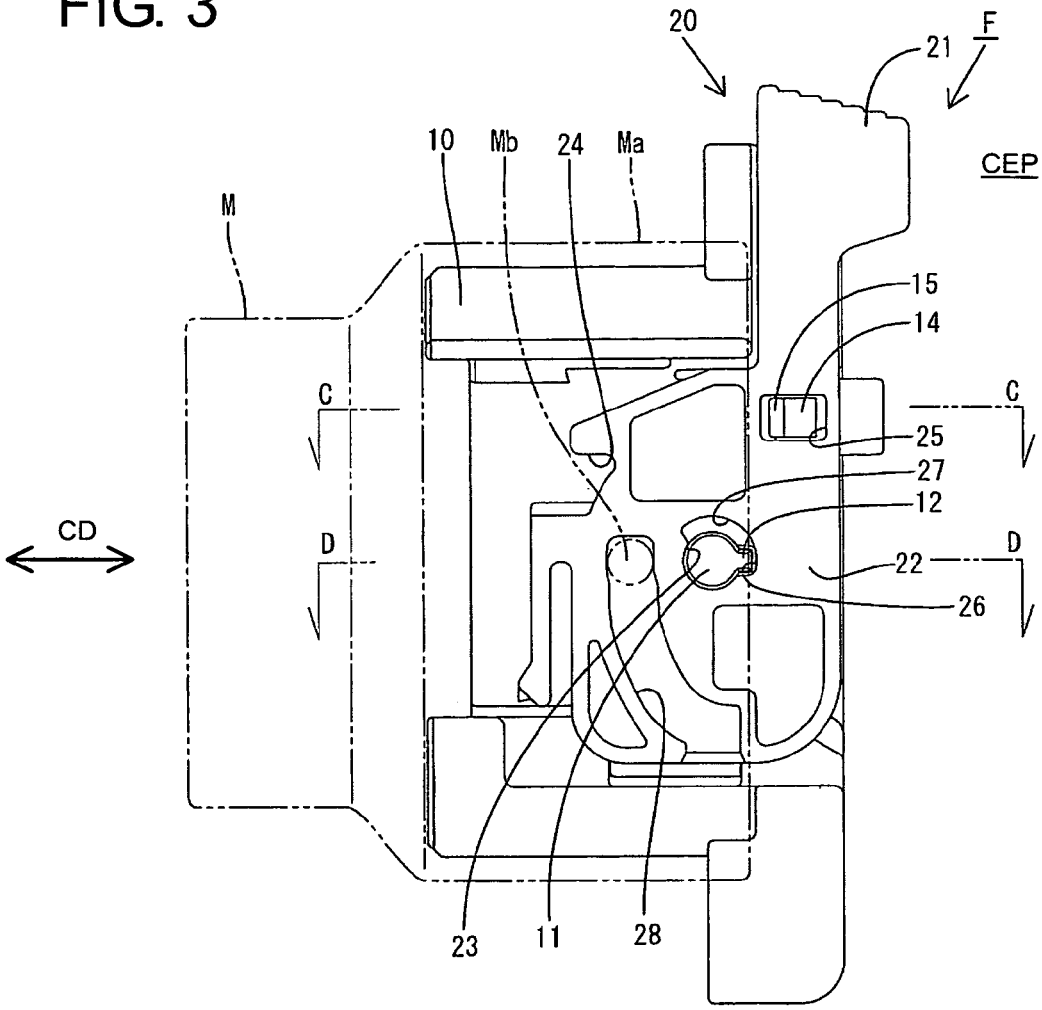
FIG. 3 is a side view showing a state where the lever is located at the connection ending position.
Figure 4:
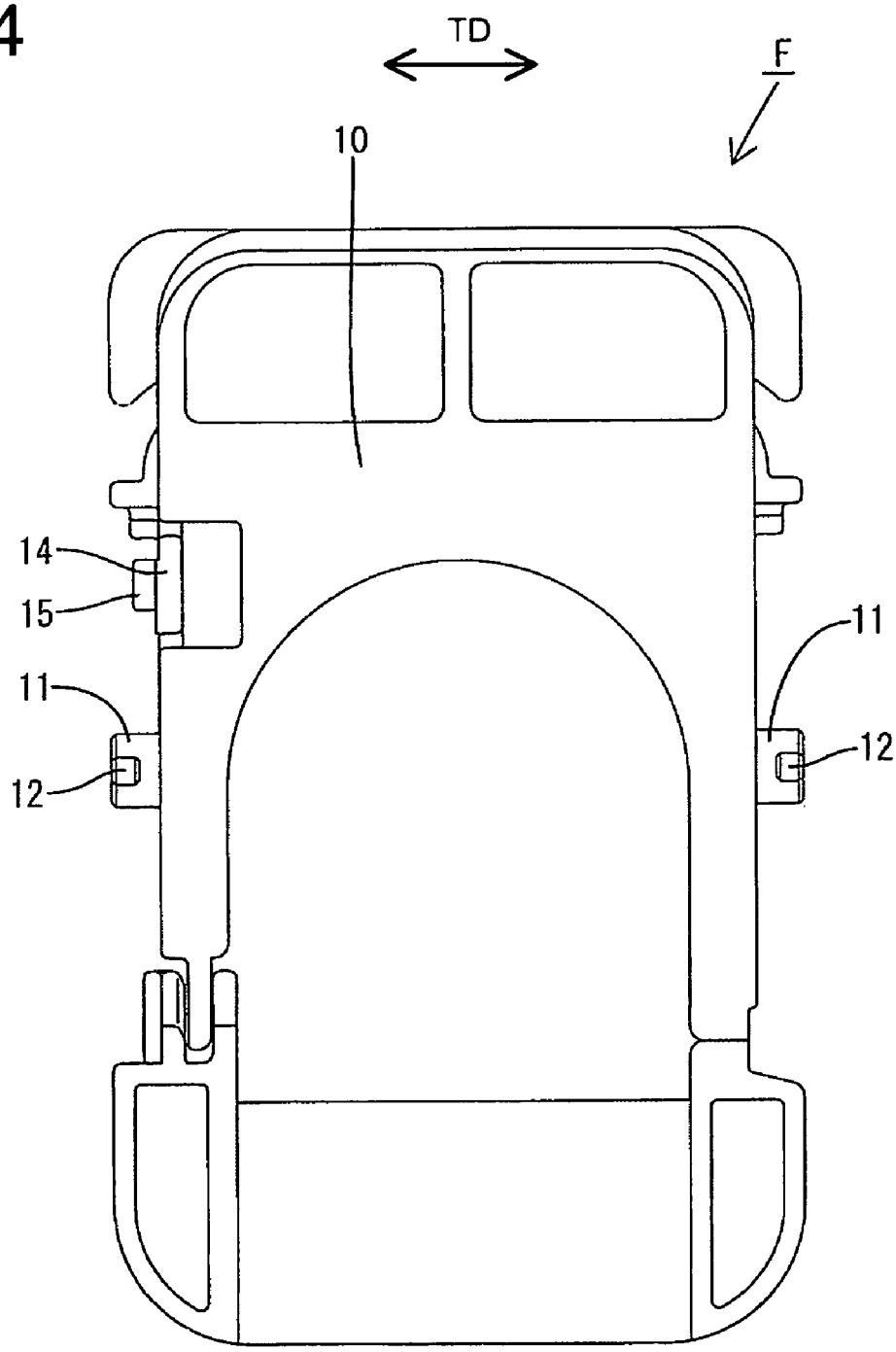
FIG. 4 is a rear view of a connector main body showing a state where the lever is detached from the connector main body.
Figure 5:
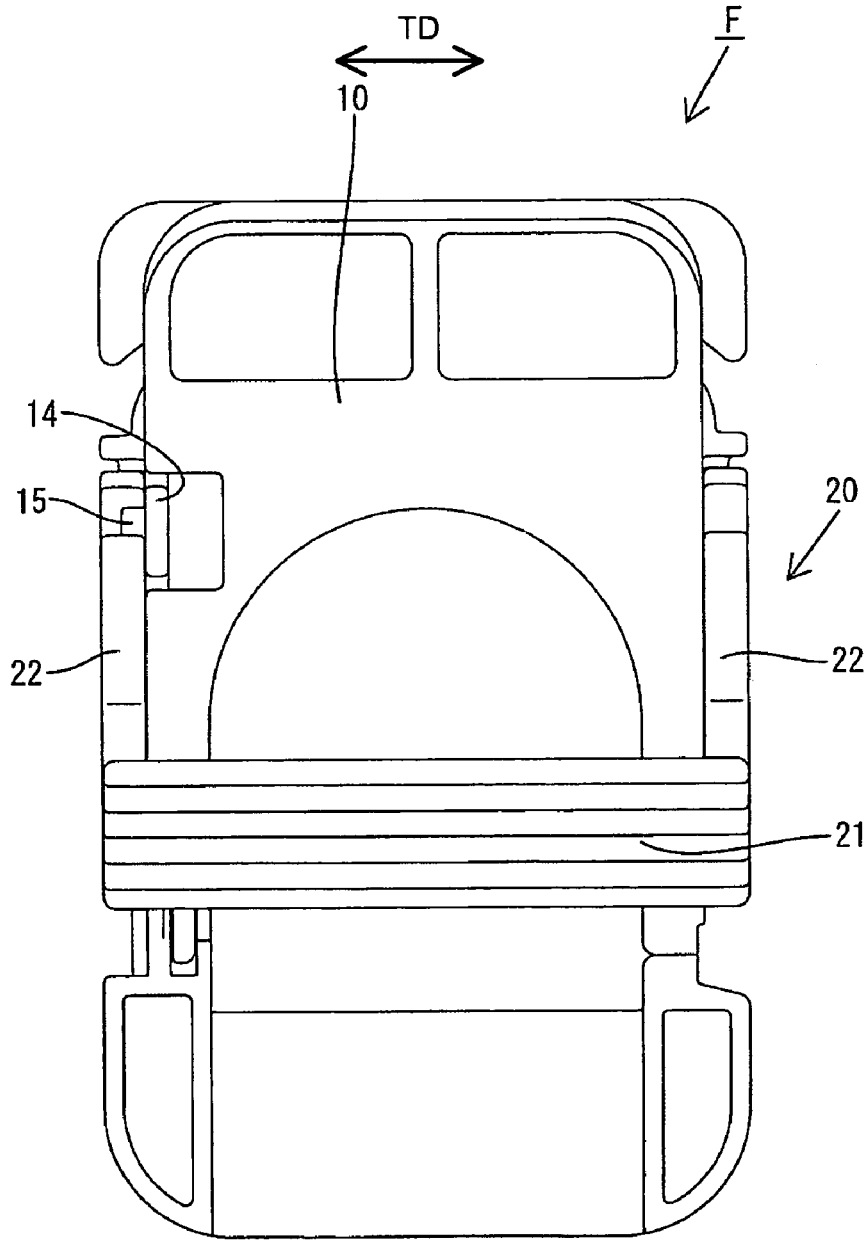
FIG. 5 is a rear view of the connector main body having the lever mounted thereon.
Figure 6A:
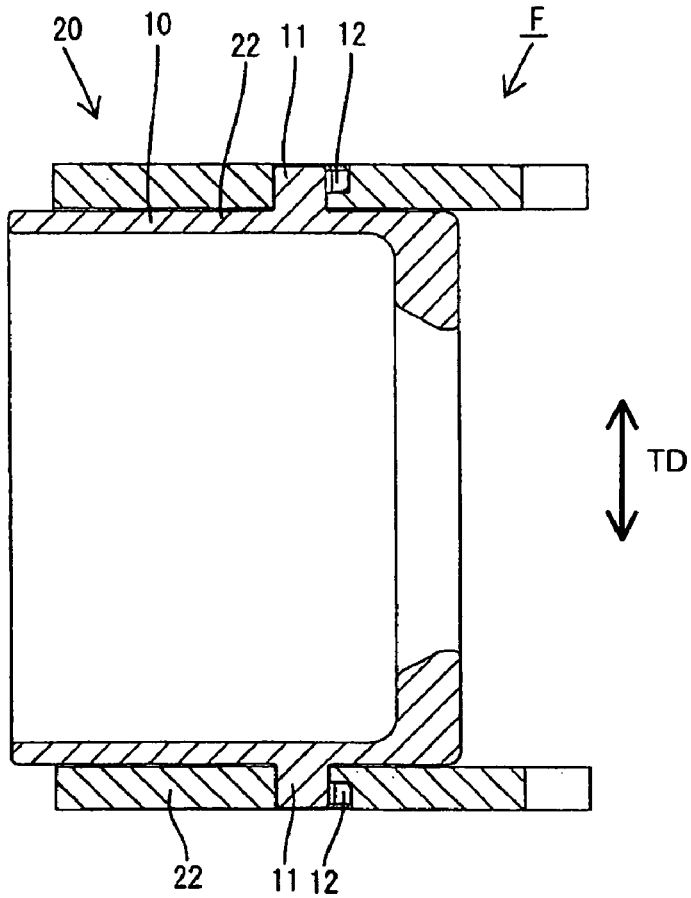
FIGS. 6(*a*) and 6(*b*) are a section along 6*a*—6*a* of FIG. 1 and a partial enlarged view of FIG. 6(*a*).
Figure 6B:
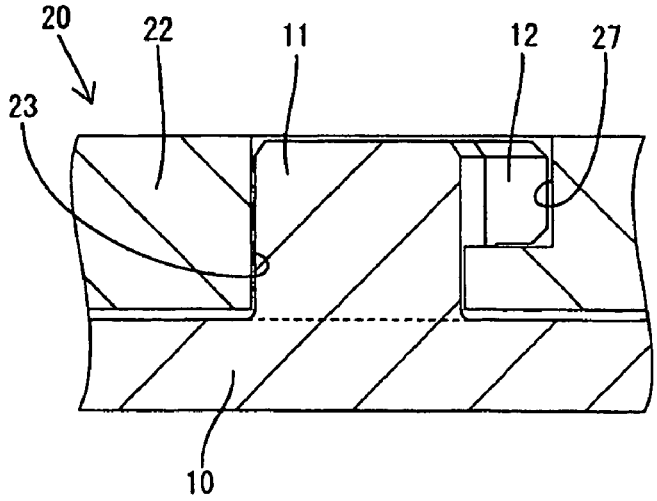

A connector assembly according to the invention includes a lever-type connector F and a mating connector M, as illustrated in FIGS. 1 to 9. The mating connector M has a long rectangular receptacle Ma that opens towards a front side (right in FIG. 3). Two cylindrical cam followers Mb project in a transverse direction TD (substantially normal to the plane of FIG. 3) from inner side surfaces of the receptacle Ma. The lever-type connector F has a body 10 and a lever 20 that can be rotated on the body 10 for moving the body 10 and the mating connector M along a connecting direction CD into or out of connection with one another.

The body 10 is made e.g. of a synthetic resin and terminal fittings (not shown) are accommodated therein. Shafts 11 project out substantially perpendicularly from the opposite lateral outer surfaces of the body 10 so that longitudinal axes of the shafts 11 extend substantially in a transverse direction TD. Each shaft 11 is substantially cylindrical, and a retainer 12 projects radially from the outer circumferential surface of the leading end of the shaft 11. The retainer 12 is substantially rectangular when viewed in the longitudinal direction of the shaft 11, and projects back from the outer circumferential surface of the shaft 11 away from the mating connector M. A dimension of each retainer 12 along a vertical direction is smaller than the outer diameter of the shaft 11, and the centers of the retainers 12 along the vertical direction are at substantially the same height as the centers of the shafts 11. The outer surfaces of the retainers 12 are substantially flush with the projecting end surfaces of the shafts 11, and clearances are defined between the inner surfaces of the retainers 12 and the outer side surfaces of the body 10.

A resilient lock 14 cantilevers back from an upper position on the left outer surface (front surface in FIGS. 1 to 3) of the body 10 near a rear edge of the body 10. Thus, the resilient lock 14 is higher than and rearward of the shaft 11. The resilient lock 14 is resiliently deformable in a deformation direction DD, which is substantially along the transverse direction TD. Therefore, the resilient lock 14 deforms in a direction substantially parallel with the longitudinal axes of the supporting shafts 11 and substantially normal to a rotating direction of the lever 20. The outer surface of the resilient lock 14 is substantially flush with the outer side surface of the body 10 when the resilient lock 14 is unbiased and not deformed. A locking projection 15 is formed on the outer surface of the resilient locking 14 and projects out from the outer side surface of the body 10 when the resilient lock 14 is unbiased.

The lever 20 is made e.g. of a synthetic resin and includes an operable portion 21 and two substantially parallel plate-shaped arms 22 that extend from the opposite left and right ends of the operable portion 21. Thus, the lever 20 is substantially gate-shaped or bridge-shaped. The planar surfaces of the arms 22 are substantially parallel with the outer side surfaces of the body 10. Bearing holes 23 penetrate the arms 22 from the inner surfaces to the outer surfaces and have center axes aligned with one another along the transverse direction TD. The bearing holes 23 are substantially round, and have inner diameters that are equal to or slightly larger than the outer diameters of the shafts 11. Thus, the bearing holes 23 can engage the shafts 11 so that the lever 20 is supported on the body 10 for rotation through an angle of between about 60° and about 120°, and most preferably about 90° between a connection starting position CSP (see FIG. 1) and a connection ending position CEP (see FIG. 3).

Inner surfaces of the arms 22 are at substantially right angles to the longitudinal axes of the shafts 11, and are substantially in contact with or slightly spaced from the outer side surfaces of the body 10. Thus, the inner surfaces of the arms 22 substantially slide in contact with the outer side surfaces of the body 10 in the process of rotating the lever 20 between the connection starting position CSP and the connection ending position CEP. Each arm 22 has a recessed escaping portion 24 at a portion of the outer peripheral edge of the arm 22 that corresponds to the resilient lock 14 when the lever 20 is at the connection starting position CSP. A locking hole 25 is formed in a part of the arm 22 corresponding to the resilient lock 14 when the lever 20 is at the connection ending position CEP.

Figure 7:
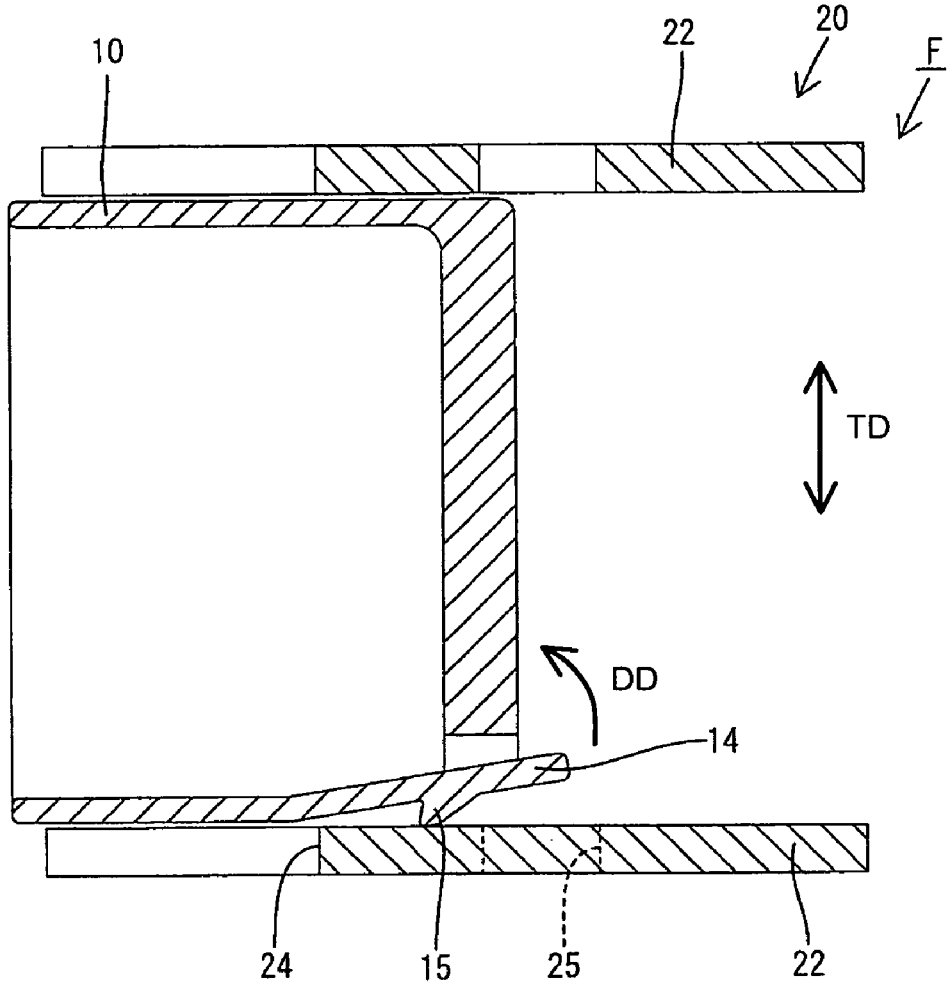
FIG. 7 is a section along 7—7 of FIG. 2.
Figure 8:
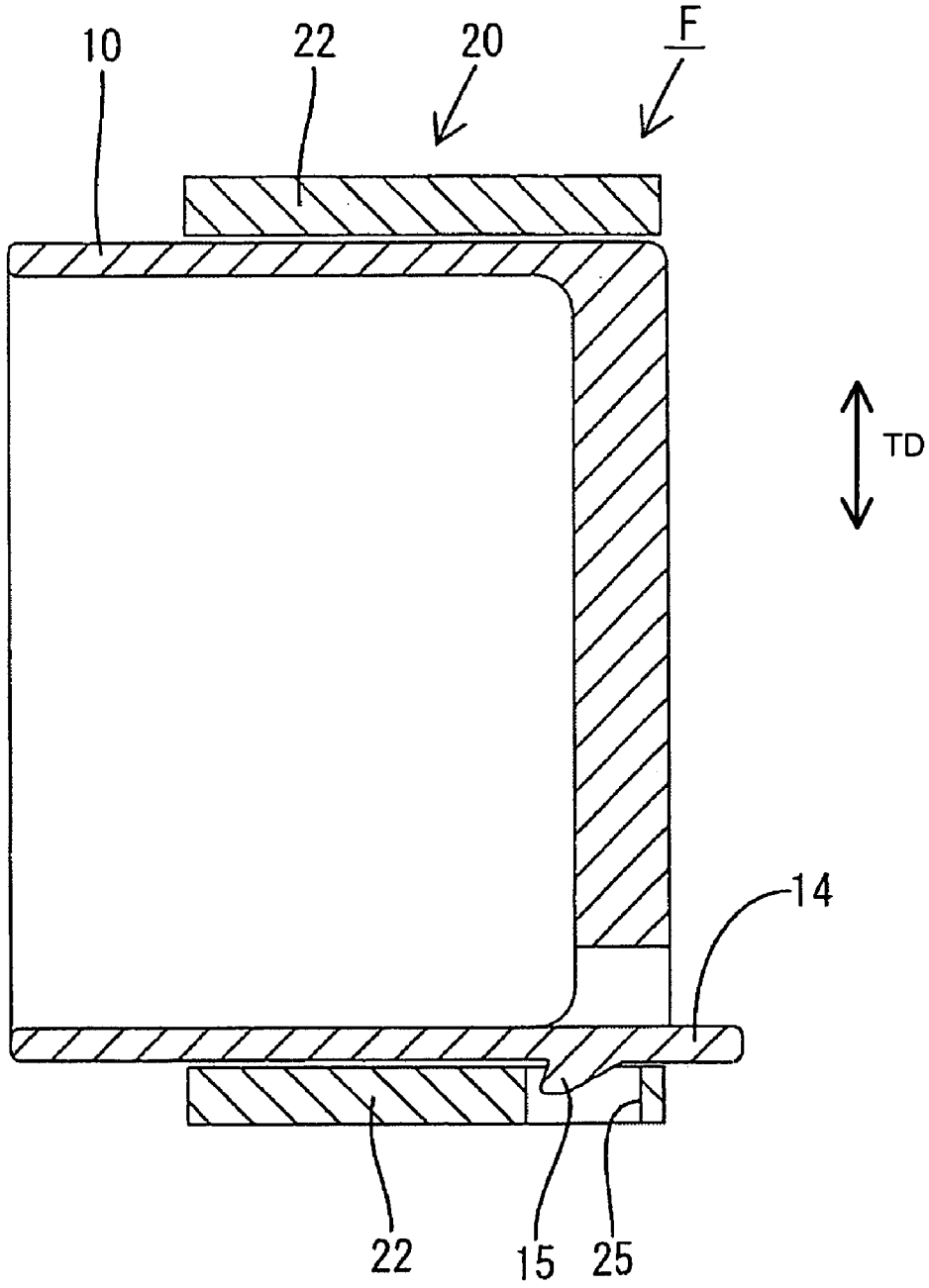
FIG. 8 is a section along 8—8 of FIG. 3.
Figure 9A:
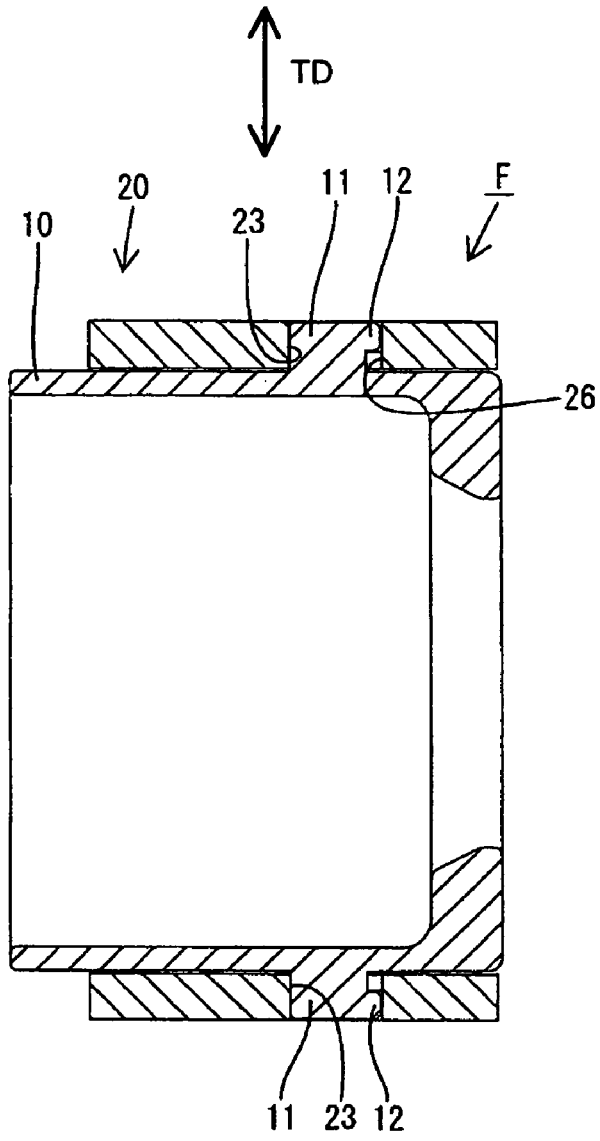
FIGS. 9(*a*) and 9(*b*) are a section along 9*a*—9*a* of FIG. 3 and a partial enlarged view of FIG. 9(*a*).
Figure 9B:
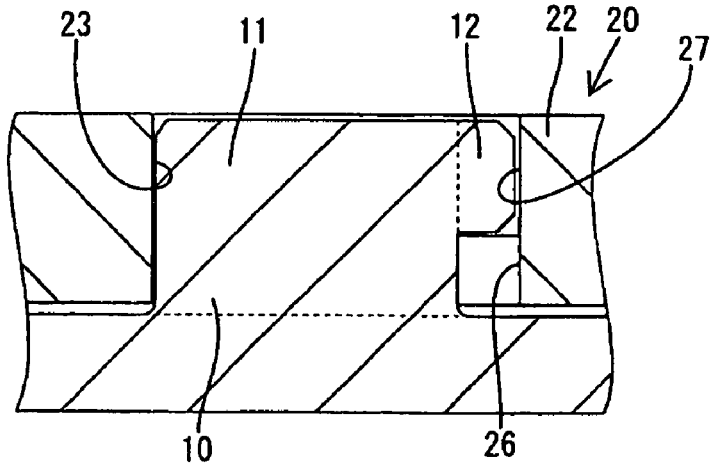

The resilient lock 14 constantly faces the inner surface of the arm 22 at all rotatable positions of the lever 20 between the connection starting position CSP and the connection ending position CEP. Thus, the locking projection 15 interferes with the inner surface of the arm 22 and the arm 22 deforms the resilient lock 14 inward, as shown in FIG. 7. In this state, a restoring force of the resilient lock 14 exerts an outward pressing force on the arm 22 in a direction substantially parallel with the longitudinal axis of the shaft 11 and towards the projecting end of the shaft 11.

The rotatable area of the lever 20 is comprised of an interference area and a non-interference area. The resilient lock 14 interferes with the inner surface of the arm 22 and is deformed when the lever 20 is in the interference area. The resilient lock 14 is unbiased and not deformed when the lever 20 is in the non-interference area. The connection ending position CEP and the connection starting position CSP are in the non-interference area. The interference area extends through the long arc between the connection ending position CEP and the connection starting position CSP.

Each bearing hole 23 has a notch 26 at a part of the opening edge. Each notch 26 has a necessary and minimum shape to permit the passage of the retainer 12 of the shaft 11 in the longitudinal direction of the shaft 11. Thus, each notch 26 has substantially the same shape and dimensions as the retainer 12. The notches 26 align with the retainers 12 to permit passage of the retainers 12 only when the lever 20 is at the connection ending position CEP. Therefore, the bearing holes 23 of the arms 22 can be attached to and detached from the shafts 11 only at the connection ending position CEP. More particularly, the notches 26 are oriented in correspondence to the retainers 12 when the lever 20 is in the connection ending position CEP. However, the notches 26 do not align with the retainers 12 or align only partly with the retainers 12, if the lever 20 is rotated only slightly from the connection ending position CEP towards the connection starting position CSP. In this unaligned state, the retainers 12 engage the opening edges of the bearing holes 23 from the outer side. As a result, the retainers 12 cannot pass the notches 26, and the arms 22 cannot be attached to and/or detached from the shafts 11.

A substantially arc-shaped recess 27 is formed along the opening edge of the bearing hole 23 in the outer surface of each arm 22, and the retainer 12 is accommodated in the recess 27. The projecting end surface of the retainer 12 accommodated in the recess 27 is substantially flush with the outer surface of the arm 22. The notch 26 is in a formation area of the recess 27. The recess 27 is formed in a necessary and minimum area to constantly accommodate the retainer 12 in the recess 27 while the lever 20 is rotated between the connection starting position CSP and the connection ending position CEP.

An arc-shaped cam groove 28 is recessed lightly in the outer surface of each arm 22 from a position near the shaft 11 to the outer peripheral edge of the arm 22. The entrances of the cam grooves 28 face forward towards the mating connector M and substantially along the connecting direction CD when the lever 20 is at the connection starting position CSP. Accordingly, the cam followers Mb of the mating connector M can enter the cam grooves 28 in this state. The lever 20 is rotated towards the connection ending position CEP while the cam followers Mb are at the entrances of the cam grooves 28. As a result, the cam grooves 28 engage the cam followers Mb and pull the mating connector M towards the body 10 so that the body 10 fits into the receptacle Ma. The mating connector M and the body 10 are connected properly when the lever 20 reaches the connection ending position CEP.

The resilient lock 14 faces the escaping portion 24 and does not contact the arm 22 when the lever 20 is at the connection starting position CSP (non-interference area). Thus the resilient lock 14 is unbiased and undeformed at the connection starting position CSP.

The inner surface of the arm 22 interferes with the locking projection 15 when the lever 20 is rotated from the connection starting position CSP. Thus, the resilient lock 14 deforms in the deformation direction DD, as shown in FIG. 7. The locking projection 15 slides in contact with the inner surface of the arm 22, and the resilient restoring force of the lock 14 exerts an outward pressing force on the arm 22 towards the projecting end of the shaft 11. However, the retainer 12 of the shaft 11 is spaced from the notch 26 of the bearing hole 23 and engages the outer surface of the arm 22 from the outer side (see FIG. 6). Thus, even if the arm 22 is pressed outward, the arm 22 cannot disengage from the shaft 11. The retainers 20 prevent the lever 20 from being detached while the lever 20 is between the connection starting position CSP and a position slightly toward the connection starting position CSP from the connection ending position CEP.

The locking hole 25 faces the resilient lock 14 when the lever 20 is at the connection ending position CEP (non-interference area). Thus, the resilient lock 14 is restored to the unbiased state and does not contact the arm 22 (see FIG. 8). Accordingly, the resilient lock 14 exerts no pressing force on the arm 22 towards the projecting end of the shaft 11. The retainers 12 align with the notches 26 at the connection ending position CEP. Thus, the retainers 12 can pass the notches 26 and the arms 22 can be attached to and detached from the shafts 11 (see FIG. 9). However, the resilient lock 14 does not press the arm 22, and hence the arm 22 is not detached from the shaft 11 as long as an external force is given to the arm 22 in an opening direction away from the other arm 22. Therefore, the lever 20 is kept fit to the shafts 11.

The locking projection 15 of the resilient lock 14 engages the edge of the locking hole 25 (see FIG. 8) and prevents rotation of the lever 20 towards the connection starting position CSP. The receptacle Ma of the mating connector M is located around the body 10 and faces the outer surfaces of areas of the arms 22, including the shafts 11, when the connector F is connected with the mating connector M by the rotation of the lever 20. Thus, the arms 22 cannot displace in opening directions and cannot detach from the shafts 11.

As described above, the notches 26 and the retainers 12 align only when the lever 20 is in the non-interference area, i.e. where the resilient lock 14 is not deformed. The resilient lock 14 presses the lever 20 and the retaining projections 12 engage the opening edges of the bearing holes 23 while the lever 20 is in the interference area. Thus, the lever 20 cannot detach from the shafts 11.

The lever-type connector F is transported to a site for connection with the mating connector M with the lever 20 at the connection starting position CSP for an efficient connecting operation. The retainers 12 and the notches 26 are not aligned at the connection starting position CSP. Hence, the lever 20 cannot be detached from the body 10 during transportation.

The resilient lock 14 faces the escaping portion 24 and is not deformed when the lever 20 is at the connection starting position CSP. Thus, the resilient lock 14 is not set in fatigue even if the lever 20 is left at the connection starting position CSP over a long period.

The resilient lock 14 exerts a resilient pressing force on the inner surface of the arm 22 during the entire rotational stroke of the lever 20 between the connection starting position CSP and connection ending position CEP, excluding the connection ending position CEP. However, the retaining projections 12 and the notches 26 are not aligned during the rotation and there is no possibility that the lever 20 will detach.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the resilient lock is on the body in the foregoing embodiment, it may be on the lever according to the invention.

The non-interference area includes only the connection starting position and the connection ending position in the foregoing embodiment. However, the invention is also applicable where the non-interference area exists between the connection starting position and the connection ending position. In such a case, an arrangement may be made not to prevent the lever from rotation even if the resilient lock is in the free state where it is not resiliently deformed.

Although the resilient lock prevents rotation of the lever at the connection ending position in the foregoing embodiment, it may prevent rotation of the lever at the connection starting position according to the invention.

The movable member is a lever in the foregoing embodiment. However, the invention is applicable to movable members that have other operational modes, such as a slider that is movable along a linear or curved operation path, to display a cam action. In such case, the bearing of the movable member has a shape corresponding to the movement path of the movable member (e.g. a substantially straight or linear notch for a movable member having a substantially straight or linear movement path). The bearing hole has a shape to allow the retainer on the shaft to escape when the movable member is positioned at the connection ending position CEP.

The retainer 12 projects radially from the outer circumferential surface of the leading end of the shaft 11 in the above-described embodiment. However, the retaining structure may take other shapes provided it can retain the movable member 20 in a position different from the connection ending position CEP.

What is claimed is:

1. A connector, comprising:

a body having an outer surface and at least one shaft projecting along an axis from the outer surface, a retainer projecting from the shaft;

a movable member with at least one bearing hole engaging the shaft so that the movable member is supported movably on the body, a notch formed at an edge of the bearing hole, the retainer being receivable in the notch for permitting attachment and detachment of the movable member to and from the shaft in at least a first movement area of the movable member on the body, the retainer being misaligned with the notch for preventing detachment of the movable member from the shaft in at least a second movement area of the movable member on the body;

a resilient lock on one of the body and the movable member and being resiliently deformable in a direction substantially parallel with the axis of the shaft, the resilient lock being configured for preventing movement of the movable member when the resilient lock is not deformed; and the movable member being movable through an interference area where the resilient lock is deformed and in sliding contact with one of the movable member and the body and a non-interference area where the resilient lock is not deformed, the notch and the retainer being aligned with each other only when the movable member is in the non-interference area.

2. The connector of claim 1, wherein the movable member comprises a lever formed with the at least one bearing hole rotatably supported on the main body.

3. The connector of claim 2, wherein the lever is supported for rotation between a connection starting position and a connection ending position.

4. The connector of claim 3, wherein a cam follower of a mating connector is engageable with a cam groove of the movable member when the movable member is at the connection starting position, the mating connector being able to be pulled toward the body by the engagement of the cam groove and the cam follower in the process of moving the movable member, and the mating connector and the body being connected properly when the movable member reaches the connection ending position.

5. The connector of claim 3, wherein the connection ending position is in the non-interference area.

6. The connector of claim 3, wherein the notch and the retainer align only at the connection ending position.

7. The connector of claim 3, wherein the resilient lock in the free state prevents movement of the movable member from the connection ending position towards the connection starting position.

8. The connector of claim 3, wherein a receptacle of the mating connector can face the movable member from an outer side for preventing the movable member from being displaced from the shaft as the movable member is moved to connect the body and the mating connector.

9. The lever-type connector of claim 3, wherein the connection starting position is in the non-interference area.

10. A connector, comprising:

a body having at least one side, a shaft projecting out from the side along an axis, a retainer projecting from said shaft at a location spaced from the side, a resilient lock on the side and being resiliently deformable in a direction substantially parallel with the axis of the shaft;

a lever with at least one arm, a bearing hole formed in the arm and being mounted on the shaft for rotation between a connection starting position and a connection ending position, an escaping portion formed on said arm and aligned with the resilient lock when the lever is at the connection starting position, said resilient lock being spaced from the escaping portion when the lever is rotated from the connection starting position so that the resilient lock biases the arm out and away from the side of the body, a notch formed at an edge of each of said hole and being aligned with the retainer only when the lever is at the connection ending position for permitting attachment and detachment of the lever to and from the shaft only when the lever is at the connection ending position on the body, whereby the retainer holds the arm on the shaft at all rotational positions spaced from the connection ending position.

11. The connector of claim 10, wherein the resilient lock is unbiased when the lever is at the connection starting position and at the connection ending position.

12. The connector of claim 10, wherein the arm is formed with a cam groove for engaging a cam follower of a mating connector when the lever is at the connection starting position, the mating connector being able to be pulled toward the body by the engagement of the cam groove and the cam follower in the process of rotating the lever, and the mating connector and the body being connected properly when the lever reaches the connection ending position.

13. The connector of claim 10, wherein the resilient lock is configured to releasably hold the lever in the connection ending position.

14. The connector of claim 13, wherein the arm has a locking hole, the resilient lock being unbiased and engaging the locking hole when the lever is in the connection ending position.

* * * * *